United States Patent [19]

Mol

[11] 4,145,038

[45] Mar. 20, 1979

[54] ROTARY DRUM COLLATOR-SORTER

[75] Inventor: Hans C. Mol, Wilton, Conn.

[73] Assignee: Pitney Bowes, Inc., Stamford, Conn.

[21] Appl. No.: 811,089

[22] Filed: Jun. 29, 1977

[51] Int. Cl.[2] ..... B65H 32/045

[52] U.S. Cl. ..... 270/58; 271/173

[58] Field of Search ..... 270/52, 55, 58; 271/64, 271/173

[56] References Cited

U.S. PATENT DOCUMENTS

| | | | |
|---|---|---|---|
| 2,634,971 | 4/1953 | Schweizer | 270/55 |
| 3,881,716 | 5/1975 | Bryson | 270/58 |
| 3,970,297 | 7/1976 | Blowsky | 270/58 |

*Primary Examiner*—Edgar S. Burr
*Assistant Examiner*—A. Heinz
*Attorney, Agent, or Firm*—Martin D. Wittstein; William D. Soltow, Jr.; Albert W. Scribner

[57] ABSTRACT

A sheet handling machine having the dual capability of either collating or sorting sheet material into individual booklets or collations. The machine has a plurality of sheet receiving bins arranged within a rotary drum operatively associated with infeed and outfeed locations of the machine. The machine includes a conveyor for depositing sheets into the bins, and rotary extracting means located adjacent the bins for extracting sheets from the bins. Appropriate controls are provided to cause the rotary drum to be selectively operable in a predetermined sequence. In a sorting mode of operation, successive copies of the first page of a booklet are fed into successive bins until each bin contains one copy. Thereafter, successive copies of each successive page of the booklet are fed into each bin until each bin contains a completed booklet. Thus, as many booklets are simultaneously formed as there are bins. In the collating mode, each bin is automatically loaded with a predetermined number of the same page of the booklet, and a single sheet from each bin is extracted and conveyed to a receiving station to form a single completed booklet.

6 Claims, 8 Drawing Figures

| | LINE | INPUTS | | | OUTPUTS | | | |
|---|---|---|---|---|---|---|---|---|
| | | OVER UNDER 50 0=AUTO LOAD | COMPARATOR STATUS | SHEET COUNT | STEP | COUNTER RESET | DRUM STEPPER RESET | SINGLE STEP LATCH-RESET-STEP |
| | | A | B | C | W | X | Y | Z |
| AUTO | 1 | 0 | 0 | 0 | 0 | 0 | 0 | 0 |
| | 2 | 0 | 0 | 1 | 0 | 0 | 0 | 1 |
| | 3 | 0 | 1 | 0 | 0 | 0 | 0 | 0 |
| | 4 | 0 | 1 | 1 | 0 | 1 | 0 | 1 |
| SORT | 5 | 1 | 0 | 0 | 0 | 0 | 0 | 0 |
| | 6 | 1 | 0 | 1 | 1 | 0 | 0 | 0 |
| | 7 | 1 | 1 | 0 | 0 | 0 | 0 | 0 |
| | 8 | 1 | 1 | 1 | 1 | 1 | 1 | 0 |

| 50 INPUT | OUTPUT |
|---|---|
| BCD 50 AND UNDER | 1 |
| BCD 51 AND OVER | 0 |

ROTARY DRUM COLLATOR-SORTER

BACKGROUND OF THE INVENTION

1. Field of the Invention

The arts of sheet collating and sorting are well known arts that have been practiced for a very long time. A vast amount of technology has been developed, and many machines have been designed for arranging sheets of paper in a predetermined orderly fashion. With the development of fully automatic high speed printing machines, and the more recent advent of high speed copying and/or duplicating machines, there has been a steadily increasing demand for collating and sorting machines which are compatible with the large variety of printing, copying or duplicating machines presently available.

In order to better understand the development of the prior art in the above field, as well as the existing necessity for the present invention, one should have a basic understanding of the distinction between sorting and collating even though these terms have not been universally accepted as designations for the respective sheet handling methods hereinafter described. Generally speaking, in a machine in which a predetermined number of bins are to be utilized, the term sorting designates a method of sheet handling in which a plurality of successively identical copy sheets are fed into the predetermined number of bins until each bin contains one copy sheet, for example, page 1 of a twenty page booklet. Thereafter, another plurality of successively identical copy sheets are fed into the bins until each bin contains one of the second plurality of copy sheets, for example, page 2 of the twenty page booklet. This method of loading the bins is continued until each bin contains one copy of each of the twenty pages of the booklet in sequential order, so that at the end of the operation each bin contains a completed booklet. If ten bins are utilized, ten booklets will be simultaneously formed each having twenty sheets. Typically, in prior art sorting machines, notwithstanding the advantage of the sorting machine having on-line capability with a copying or duplicating machine, the completed booklets or collations must be removed at this time from the machine by hand, and the pages of each booklet are fastened together by any suitable means. Such means include conventional stapling, either by a manual operation or by feeding the booklet into an automatic jogging and stapling machine of which a variety of such machines are commercially available.

In the method of collating, a machine having a plurality of bins is preloaded with a predetermined number of identical sheets. After the bins have been loaded, a feeding means asociated with each bin, ejects one sheet at a time from each bin in order to form a collation (booklet) containing tthe desired number of sheets. In this mode of operation, each collation is formed individually, rather than all collations formed simultaneously. This is because the sheets are ejected from the bins in the same order as the numerical order of the pages that form the collation for each cycle of operation of the machine. Thus, for example, if it is desired to generate fifty booklets each having ten pages, each of ten bins is preloaded with fifty copies of a page of the booklet. The feeding means associated with each bin then operates to eject the ten pages, either simultaneously or successively, so that during one operating cycle of the machine, ten pages in numerical order are delivered to a receiving station. Thus, the fifty booklets are formed by running the machine through fifty cycles of operation in the above manner.

Notwithstanding the disadvantage of the requirement for hand loading typical prior art collating machines, one of the advantages of these prior art collating machines was the capability of automatically finishing each booklet as it is formed by placing any of a variety of stapling or stitching machines which are commercially available on-line with the collator.

It will thus be seen that the sorting technique is mmost efficiently utilized when it is desired to generate a small number of booklets each having a large number of pages, whereas the collating technique is most efficiently utilized when it is desired to generate a large number of booklets each having a small number of pages.

Another convenient way of easily recognizing the distinction between sorting and collating is to consider that in sorting the number of bins equals the number of booklets which can be formed regardless of the number of pages, and in collating the number of bins equals the number of pages in each booklet regardless of the number of booklets which are being formed.

In the methods described above, the sorting and collating machines are each illustratively chosen to have 10 bins available to hold 50 sheets of paper. With a sorting machine, the sorting technique would be selected to form a maximum of 10 booklets of 50 pages each. With a collating machine, the collating technique would be used to form a maximum of 50 booklets each having 10 pages.

The commercial availability of products has been directed more towards machines having large numbers of bins, particlarly so in the case of sorting machines. These machines are, of course, very complex in construction and operation, and highly sophisticated in the manner in which they can be programmed to generate multiples of booklets in a single operating cycle. They are also extremely expensive. All of these factors tend to make these machines attractive only to operators of very large commercial duplicating centers, or to print shops which handle extremely large volume jobs, e.g. 100 or more pages per booklet for a collating operation or many thousands of booklets having a relatively small number of pages for a sorting operation. The result of this situation, is that the average user of sorting and collating machines does not have freedom of choice to choose the best method of paper handling conducive to the size and number of booklets which he desires to form. The user must of necessity purchase either a larger collating machine or a larger sorting machine and use either machine efficiently for only one type of booklet formation and very inefficiently for the other type of booklet formation for which it wasn't designed. His only other choice is to farm out his sorting and/or collating jobs to outside print shops which can afford to maintain the necessary number and size of machines to handle all types of jobs. Of course, all of the aforementioned alternatives result in the individual paying a higher per unit cost for smaller jobs.

The present invention, as will be more fully appreciated hereinafter, is directed to the provision of a combined sorting and collating machine. The invention provides the capability of performing both of the above described sheet handling methods in a single machine, whose bin capacity is within a range most suitable for the user of larger sorting and collating equipment. The combined sorting and collating machine of the present invention will handle any sorting job in which the number of booklets to be formed is limited to the number of bins available (the number of pages per booklet being limited only by the sheet capacity of the bins). The machine will also handle any collating job in which the number of pages in each booklet is limited to the number of bins in the machine (the number of booklets which can be formed being limited only by the sheet capacity of each bin). It will be apparent that the machine of the present invention will meet all of the sorting and collating requirements of users within a range statistically determined to cover the vast bulk of such users.

Another advantage with this type of machine is that if the machine is constructed with relatively large bins, it an be used in a sorting mode to form booklets having an extremely large number of pages, and can be used in a collating mode to form an extremely large number of booklets. This advantage is helpful for those situations where a sorting or collating run extends beyond the range of a normal (average) run.

A still further significant advantage of the combined sorting and collating machine of the present invention is its capability of automatically loading sheets for the collating mode. The machine is operated in a semi-sorting mode in which identical sheets are loaded into the same bin, and successions of subsequent sheets are each loaded into respective successive bins. The resulting procedure provides an automatic loading of the machine which will thereafter be operated in a collating mode.

The machine of the present invention is so designed and constructed to perform functions neither contemplated nor possible with prior art machines. The machine of the present invention also performs the same functions as those prior art machines, but with much less complicated structure, and in a more efficient manner. The invention achieves this, while at the same time achieving changeover from one mode of operation to another.

SUMMARY OF THE INVENTION

The present invention relates generally to a copy sheet handling apparatus, and more particularly to a combined sorting and collating machine which can be operated selectively to organize printed copy sheet material by either sorting or collating techniques.

The sorting and collating machine generally comprises a means defining a sheet infeed location and a sheet outfeed location. Operatively associated with these locations is a plurality of adjacent sheet receiving and storing bins arranged within a rotary drum. A conveyor means is operatively associated with the plurality of bins, for conveying sheets seriatim from the infeed location for deposit into the plurality of bins. A rotary extracting sheet means is disposed adjacent the drum for extracting sheets from the bins to the outfeed location of the machine.

The machine includes a first control means for depositing successive sheets from the conveyor means into a preselected one or more of the plurlaity of bins. A second control means is provided for actuating the sheet extracting means to cause the sheet extracting means to extract sheets in a selectable succession from the bins. There is also a selector means operatively associated with the first control means for selectively loading the drum in a desired mode of operation, i.e., either in a sorting or auto-loading mode preparatory to collating.

Having briefly described the general nature of the present invention, it is a principal object thereof to provide a combined sorting and collating machine.

It is another principal object of the invention to provide a combined collating and sorting machine that will automatically load sheets preparatory to operating the machine in a collating mode.

It is another object of this invention to provide a combined collating and sorting machine in which the sheet conveying and storing components are arranged to facilitate the collating and storing machine being placed on line with one or both of a duplicating machine and a set finishing machine.

It is another object of this invention to provide a collating and sorting machine of rotary drum design which can be utilized for both sorting and automatic loading preparatory to collating and which utilizes electronic controls to cause operation of the machine in a preselected mode of operation.

It is another object of this invention to provide a collating and sorting machine which is relatively simple in construction, is easy to operate and maintain and provides greater flexibility than heretofore possible with prior art collating machines or sorting machines.

These, and many other objects of this invention, will become more apparent and wil be better understood with reference to the following detailed description taken in conjunction with the accompanying drawings, in which.

Figure 4:
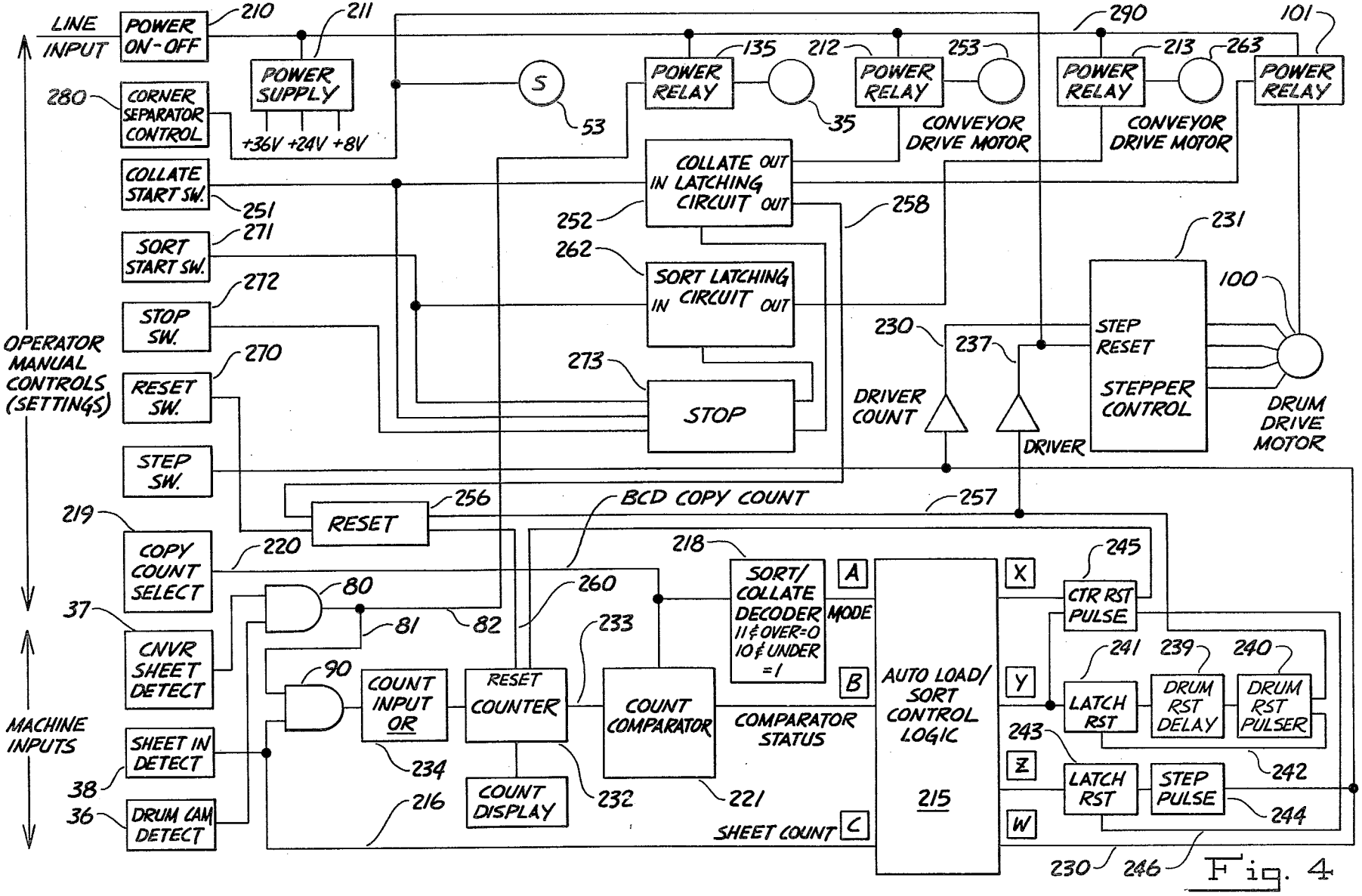
FIG. 4 is an electrical schematic of the control circuitry for the invention of FIG. 1.
Figures 4A, 4B:
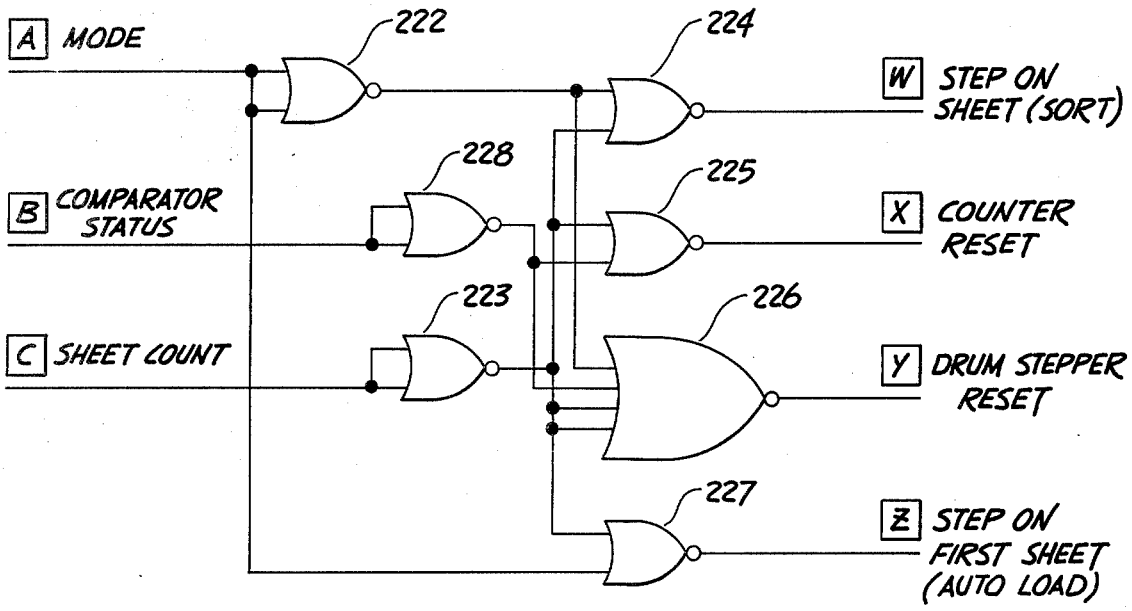
Figures 4C, 4D:
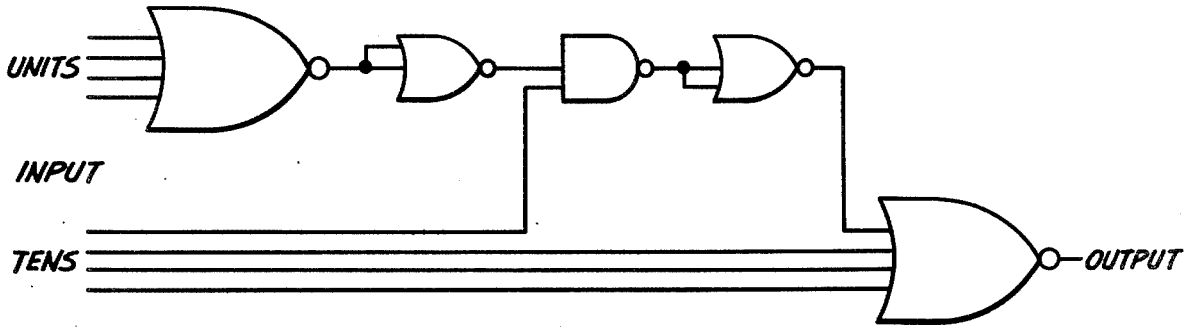

FIG. 4*a* is a detailed electrical schematic of the auto load/sort control logic depicted in FIG. 4;

FIG. 4*b* is a truth table for the auto load/sort control logic illustrated in FIG. 4*a*;

FIG. 4*c* is a schematic view of the sort/collate decoder circuit shown in FIG. 4; and FIG. 4*d* is a truth table for the sort/collate decoder circuit depicted in FIG. 4*c*.

Figure 1:
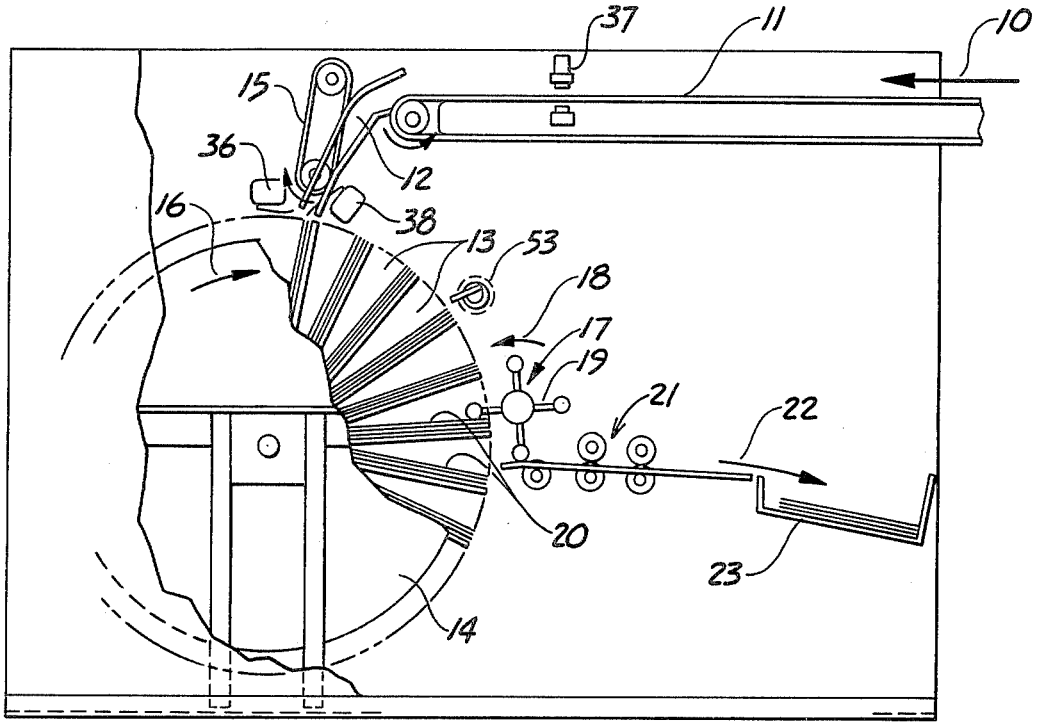
FIG. 1 is a schematic side view of the inventive combined collator-sorter in situ with a copier machine.

Now referring to FIG. 1 a schematic view of the combined collating and sorting apparatus of this invention is shown.

Sheets from a copier or printing machine are conveyed (arrow 10) by a conveyor belt 11 to a guide chute 12. Sheets entering the guide chute 12 are power propelled via conveyor belt 15 into the sheet receiving bins 13 of a rotatable (arrow 16) drum 14.

In a sorting mode or auto-load (collate loading) mode, the drum 14 is rotatively indexed, such that each bin 13 is stopped adjacent chute 12.

The rotatable drum 14 and spider 17 are constructed and operates in like manner to the collator system shown in the patent issued to Blowsky, U.S. Pat. No. 3,970,297. In a collator ejecting mode, the drum 14 rotates (arrow 16) continuously, while a spider wheel 17 rotates (arrow 18) in synchronism with the drum. Each arm 19 of the spider 18 successively enters a bin 13 of the drum to frictionally engage with the top sheet of a stack of sheets 20 therein stored. The engaged sheets are frictionally pushed from the bins 13 to a conveyor 21, which further transports (arrow 22) the sheet material to a stacker 23 or a finishing device. The finishing apparatus may be any one of a number of commonly known devices for stapling or stitching sheet material.

Figure 2:
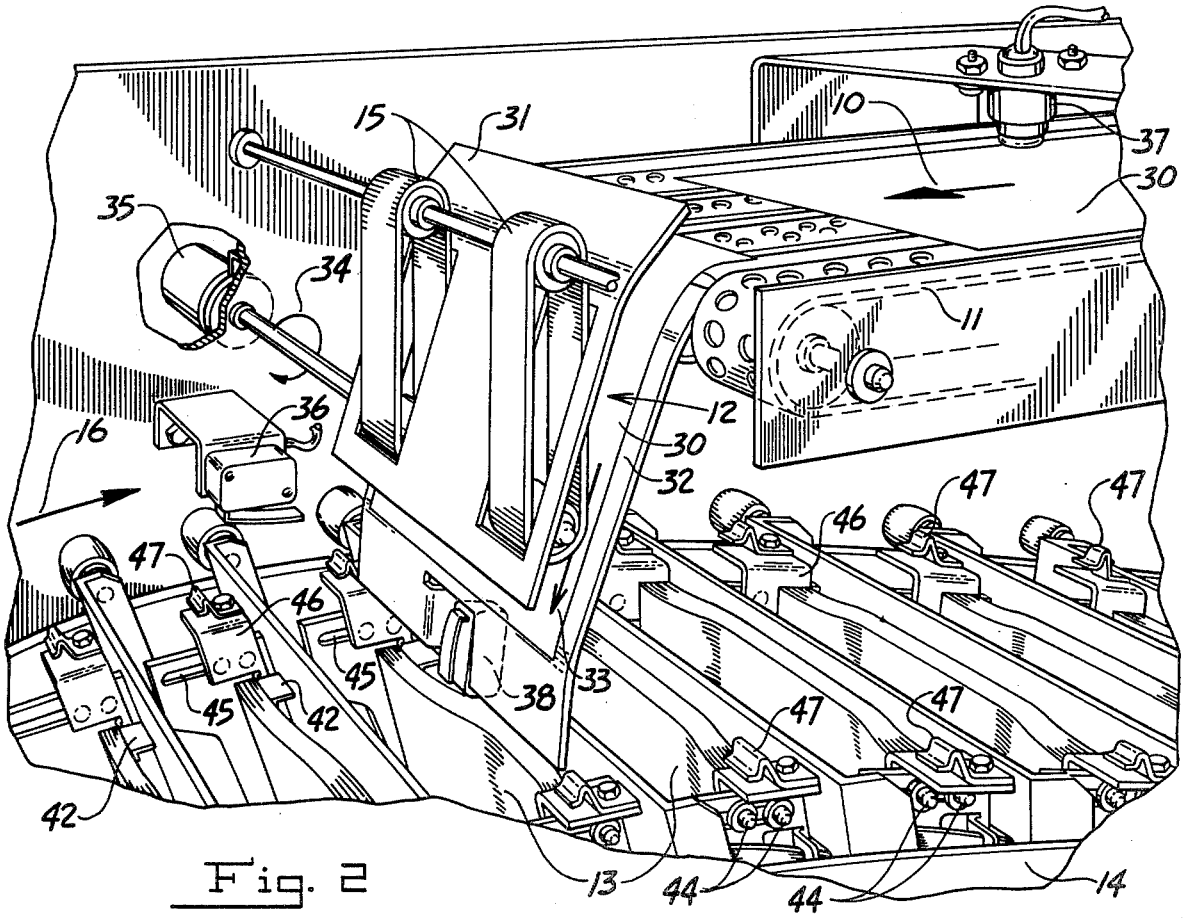
FIG. 2 is a partial perspective view of the invention of FIG. 1, showing in a more detailed fashion the ingress of sheet material into the bins of the machine.

FIG. 2 is a more detailed perspective view of the incoming sheet conveying mechanism of FIG. 1. As aforementioned, sheets 30 are conveyed (arrow 10) via a conveyor belt 11, from a copier or printing machine (not shown). The sheets 30 next enter a chute 12 comprising two plates 31 and 32, respectively. The plates are angled in such a way as to guide sheets 30 into respective pockets or bins 13 of drum 14. In order to better control the feed of each sheet into its corresponding bin, power assist conveyor belts 15 contact each sheet 30 disposed in the chute 12, and propel (arrow 33) the sheet 30 into its bin. Belts 15 are rotatively (arrow 34) powered by a motor 35, which is electrically controlled by detectors 36 and 37, as will be explained, hereinafter.

Drum 14 is rotatively indexed (arrow 16) adjacent chute 12. A switch 36 (FIGS. 1 and 2) detects the bin indexing positions, so that each respective bin position is properly detected. The switch 36 is electrically tied via And gate 80 with the sheet conveyor detect photocell 37 (FIG. 1) which senses each incoming (conveyed) sheet 30.

Motor 35 controlling the propulsion of a sheet 30 via belts 15, depends from its activation on the two sensors 36 and 37, respectively, i.e., upon the following two conditions being met:

(a) a sheet 30 is being conveyed to chute 12 (sensor 37); and (b) the respective bin 13 is in a sheet receiving position (sensor 36).

After the sheet 30 has been delivered to its respective bin 13 (assuming the sorting mode) the drum 14 is indexed to the next bin 13. This is accomplished via switch 38, which detects the passage of sheet 30 from chute 12.

When sheet 30 has been detected by sensor 38, the drum stepper control 231 will actuate the drum stepper motor 100 (FIG. 4) into rotating the drum 14 one bin position.

In the autoloading mode (loading for collating), the sensor 38 will continue to detect each sheet 30 being delivered to a respective bin 13 until a desired number is reached. At that time, the stepper control 231 will actuate motor 100 into rotating the drum 14 one bin position.

The logic for operating the collator-sorter combination in its various modes will be discussed in greater detail hereinafter, with respect to FIGS. 4, **4*a*–4*d***.

Figure 3:
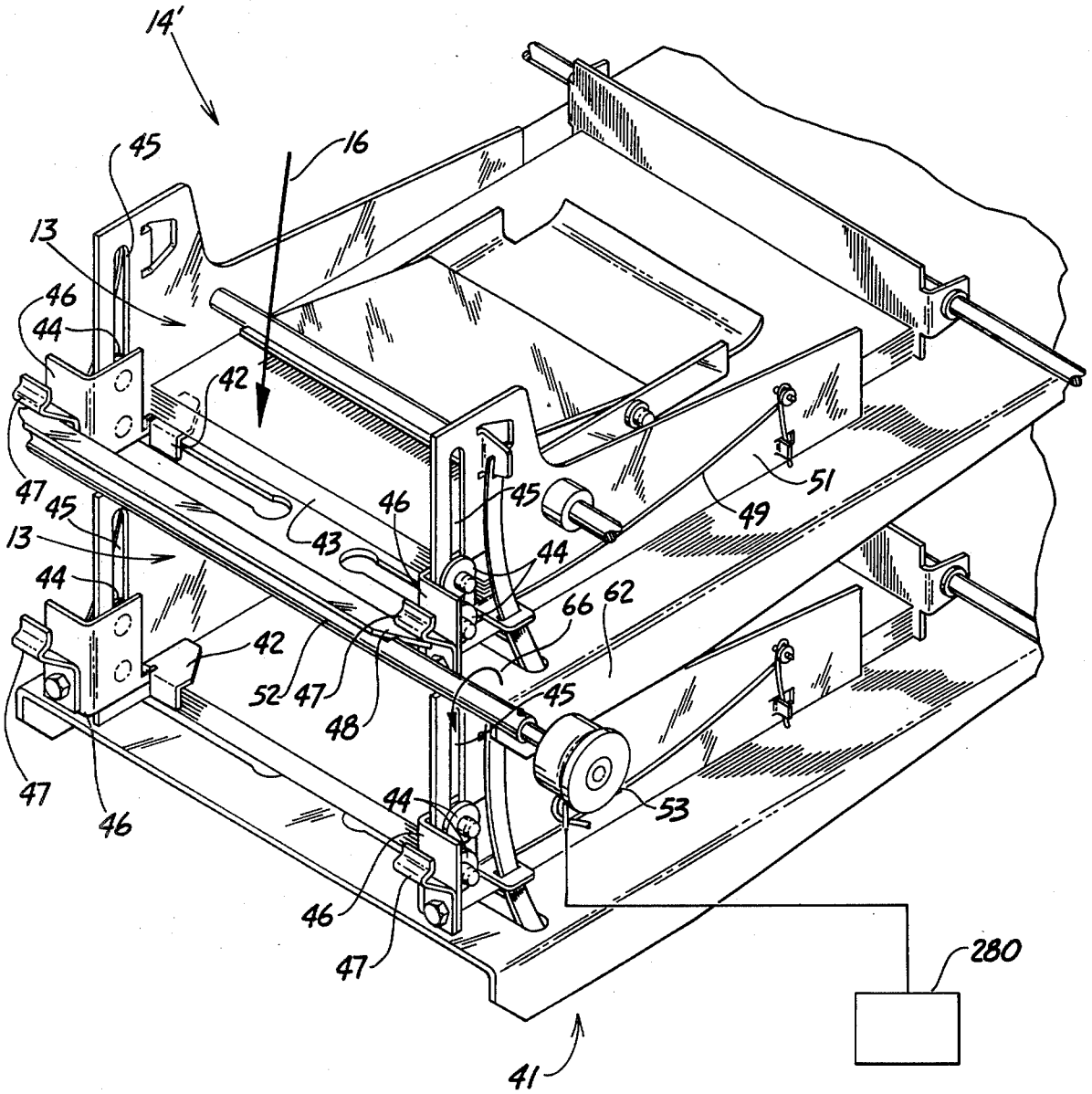
FIG. 3 is a partial perspective view of the invention of FIG. 1, illustrating in more detailed fashion the mechanism for preparing the sheets in the bins of the collating and sorting machine for ejection therefrom.

Now referring to FIGS. 1 and 3, a mechanism is shown for adjusting the corner separators in each bin 13 of said drum. FIG. 3 shows a cutaway view of the drum 14 of FIGS. 1 and 2, as the drum 14 is moving past (arrow 16) the corner separator adjustment device, shown generally by arrow 41 (FIGS. 1 and 3). The corner separators 42 are normally in a downward position, when the bins 13 are being loaded. As such, the stack of sheets 43 in each bin, which develops from the insertion of individual sheets, initially covers over the separators 42, as shown in the upper bin (FIG. 3). Naturally, each of the corner separators 42 must be adjusted to fit over their respective stack 43 prior to ejection from their bin, as shown in the lower bin 13 (FIG. 3). This is accomplished, as aforementioned by means of the control device 41.

The corner separators 42 (two for each bin 13) are each fixedly connected to slider members 44 via flange plate 46. The slider members 44 each move up and down in slots 46. The slider members 44 each move up and down in slots 45. Each flange member 46 carries an extension bar 47, which is adapted to engage with a camming bar 48.

During the sorting or auto-loading mode, the camming bar 48 is in a recessed position. When the sheets are to be ejected from the bins, however, the camming bar 48 is released into engaging contact with extension bars 47 as shown in FIG. 3. This engagement results in pushing the slider members upwardly along slot 45, as the drum 14 rotates by (arrow 16) the camming bar 48 (FIGS. 1 and 3). When the sliders move upwardly, they carry the separators 42 from under stack 43 to above stack 43.

A spring 49 is secured on each side of the frame 51 of each bin 13 (only one spring is shown). The spring 49 is attached to the sliders 44, and biases them downwardly. Thus, when the sliders 44 are moved upwardly, they are mechanically biased back downwardly. In this fashion, the separators are caused to be deposited upon the top of stack 43 as shown in the lower bin 13 of FIG. 3.

The extension bars 47 are made in the form of flexible springs (leaf springs). When the sliders 44 reach their upper travel limit within slots 45, the extension bars 47 are able to deformably snap free of the camming bar 48.

As aforementioned, the camming bar 48 is brought into a camming position only when the sheets are to be ejected, which of course necessitates the proper placement of the corner separators 42. The positioning of the camming bar 48 is accomplished by the rotary solenoid 53. The camming bar 48 is fixed to the rotatable shaft 52, which is rotatably fixed to, and is rotated counterclockwise by, the rotary solenoid 53. In the rotated counterclockwise position, ((arrow 66) as shown in FIG. 3, the bar 48 is in the contact position for the movement of the extension members 47. In the clockwise position, the bar 48 is in an inactive or non-contacting position. The solenoid 53 is spring-loaded so that the bar 48 is normally in the neutral non-engaging position.

When the corner separators 46 are to be positioned upon each stack 43, a solenoid switch 280 is depressed (FIG. 4). This switch is held depressed until the collating drum 14 makes a complete revolution in order to set all the corner/separators in each bin.

Switch 280 activates solenoid 53, and pulses the reset of stepper control 231 so that the drum 14 will make one complete revolution while the solenoid 53 is actuated.

DISCUSSION OF THE CONTROL SYSTEM

Before describing the control system circuitry, it will be necessary to define a few terms:

(a) "page run" or "page run cycle" is that portion of the collating or sorting operation wherein a single page, for example page 6, of a booklet is being deposited in the bin(s). For the sorting mode, each page 6 will be deposited in each respective bin selected. In the auto-load, all the pages 6 will be deposited in the sixth bin.

(b) "sheet count" is the number of sheets being counted during a page run cycle.

(c) "copy select count" is the number of sheets that are selected to be deposited during each page run cycle.

(d) "high and low signals" are generally designated by the numbers "1" and "0", respectively. However, it is well known that the logic can easily be inverted to provide a complement of signals using low signals in place of high signals and vice versa.

FIG. 4 is an electrical schematic depicting the control logic necessary to operate the collator-sorter in either of the two modes: sorting or collating.

Let us assume that the collator-sorter consists of approximately twenty bins 13, which form the drum 14, as aforementioned. The drum 14 is driven by a stepper motor 100 schematically illustrated in FIG. 4. The motor 100 is powered through a power relay 101.

When an incoming sheet passes detector 37 on conveyor 11 (FIGS. 1 and 2), a high signal is sent to AND Gate 80 (FIG. 4). As the drum 14 is stepped by the stepper motor 100 to each bin position, the detector 36 senses that the next bin 13 is properly set adjacent shoot 12, and also sends a high signal to AND gate 80. When the AND gate 80 receives both of these high signals, it sends a signal of via line 82 to power relay 135, to actuate the chute conveyor motor 35 which operates conveyor 15. The sheet in chute 12 is consequently pushed into the adjacent bin 13. AND gate 80 also sends a high signal to AND gate 90 via line 81. When the chute detector 38 senses that the sheet in the chute 12 has been delivered to its bin, it too sends a high signal to AND gate 90. AND gate 90 will then deliver a high signal to the count input 234. The count input 234 actuates the counter 232, which records a running count of each sheet being deposited in each run cycle of the collator-sorter.

A high signal is also sent from the "sheet in" detector 38 to the auto load/sort control logic 215 via line 216 to input "C". In a sorting mode, the control logic 215 also receives a high signal along line 217 at input "A" from the sort/collate decoder 218. The decoder 218 will give a high signal for any number of sheets up to the bin maximum of fifty. In the collate mode, which will be explained hereinafter, the decoder 218 will give a low signal, signifying that more sheets (over fifty) than the maximum number of bins has been selected.

The sort/collate decoder 218 is comprised of a few NOR and NAND gates illustrated in FIG. 4*c*, which are designed to follow the truth table shown in FIG. 4*d*.

The decoder 218 output is the result of selecting the desired number of sheets using a copy count select thumbwheel 219. The thumbwheel 219 will furnish the input to the decoder 218 along line 220 such that the control logic 215 will receive either a high or low signal at input "A".

The copycount select signal will also furnish an input to a count comparator 221, whose function is to compare the "running count" of the sheets in each run with the "select count". When the two counts show an equality, it is an indication that a new "page run" should be initiated, i.e., the next page of the booklet should be fed into each bin (sort mode).

As each bin is filling during a page run in the sort mode, it is seen that a high signal will be received at input "C" of control logic 215 every time a sheet passes the detector 38. When the sort mode is desired a standing high signal is received at input "A" of control logic 215.

The control logic 215 is shown in more detail in FIG. 4*a*, and its operation will be explained with reference to the truth table in FIG. 4*b*.

The signals at inputs "A" and "C" are directed to NOR gates 222 and 223, respectively. The outputs of NOR gates 222 and 223 are fed to NOR gate 224, which supplies a signal at output "W". NOR gates 225, 226 and 227 do not produce any output signals "X", "Y" or "Z" as can be seen from the truth table of FIG. 4*b* on line 6.

Therefore, every time a sheet passes detector 38, a signal will be outputted at "W". The "W" signal will be sent over line 230 to the stepper 231, which successively actuates the stepper motor 100 to move drum 14 to the next successive bin 13.

Thus, it will be observed that every time a sheet passes detector 38 during a "page run" in the sort mode, the next bin 13 will be brought into alignment with chute 12.

When a sheet of any "page run" moves past detector 38, a counter 232 which has been counting each sheet of the run, sends a signal to the comparator 221 via line 233. The counter 232 receives a signal each time a sheet passes detector 38, via the "count input" OR gate 234.

The comparator receives a "copy select count" signal from thumbwheels 219 via line 220, and the "sheet count" signal from counter 232 via line 233. The comparator compares these two signals, and if there is an equality, will provide a high signal to input "B" of control logic 215. This condition will only take place, however, when the last sheet of every "page run" moves past detector 38.

When a high signal is on all the inputs "A", "B" and "C", NOR gates 222, 228 and 223, will respectively cause output signals to be delivered by NOR gates 225, 226 and 227 (FIG. 4*a*).

Referring to the truth table of FIG. 4*b*, line 8, high inputs "A", "B" and "C", will cause outputs at "W", "X" and "Y" of control logic 215.

The "X" output will provide a counter reset pulse to reset counter 232, via line 236. The counter 232 is reset to start counting from the beginning for the next run.

The "W" output actuates the stepper 231 to operate the motor 100 for allowing deposition of the last sheet of the runcycle.

The "Y" output provides a stepper reset pulse via line 237 to return the stepper control 231 to its home position, and hence, return the drum 14 via motor 100 to its initial starting position. As will be seen, the "Y" reset pulse is delayed via delay 239. This delay allows the last sheet enough time to be deposited into the final bin (conveyor delay).

The "Y" reset pulser 240, while providing a reset pulse to line 237, will also provide a reset signal to the relay latch 241 via line 242. This will allow the next "Y" output (at the end of the next "page run") to again provide a reset pulse to line 237.

The first sheet of the next page run will now start the page run cycle all over again. There will be a series of "W" outputs to continuously step (stepper 231) the motor 100, until the last page of the page run cycle initiates still another (new) page run cycle.

When it is desired to obtain more than fifty booklets, the auto-load (collate loading) mode of operation for machine loading will be selected. The sort mode will not accommodate this number of booklets, because there are only fifty bins 13 in the present drum 14.

Naturally, the present invention is not limited to any particular number of bins.

When the auto-load (collate loading) mode is desired (as when more booklets are needed than the number of bins available), the decoder 218 will provide a low signal to input "A" of control logic 215. The input to "B" will be low, except for the last sheet of a "page run", and the input "C" will go high with each passing of a sheet before detector 38. It should be noted that for the collate loading mode, the "page run cycle" referred to above, now stands for the number of sheets of each page deposited into its respective bin, i.e., all of pages one in bin 1, all of pages two in bin 2, all of pages three in bin 3, etc.

Because in the collate mode, "A" is always low, the high "C" input for each sheet in a page run will provide a "Z" output (high signal on the output of NOR Gate 227, FIG. 4*a*). This will be seen to be true, with reference to the truth table of FIG. 4*b*, line 2.

The "Z" output (FIG. 4) of the control logic will provide only one step pulse to the stepper control 231 via line 230 throughout each page run. The normally off latch 243 will become latched on with the first "Z" output signal and trigger the step pulse one-shot timer 244 providing a step signal on the first sheet. All subsequent "Z" output signals in the page run will provide no stepping signal to stepper control 231 via line 230 and step pulser 244.

When the last sheet of a page run is obtained, the comparator 221 will compare the "sheet count" of counter 232 with the "select count" of the selector switches 219 and will find an equality. The "B" input will go high, and the condition in line 4 of the truth table (FIG. 4*b*) will be evidenced.

An output will now obtain on "X" and "Z" of control logic 215.

The "X" output will provide a reset signal to the counter 232 via line 236, to provide for the next page run. The counter reset pulse, which is provided by pulser 245, also provides a pulse to reset latch 243 via line 246. Therefore, when the first sheet of the next page run provides a "Z" output, the motor 100 will index drum 14 to the first bin 13. This will continue until all the selected bins are filled.

Now, when the sheets are desired to be sequentially ejected in collated sets from the bins, a collate start switch 251 is depressed. Latching logic or other suitable holding circuit means 252 is activated. This collating latching logic 252 will supply a signal to power relays 212 and 101. An ON/OFF switch 210 causes the power supply 211 to supply power to the control circuitry.

When power relays 212 and 101 receive the signal from the latching logic 252, they will activate motors 253 and 100, respectively, which in turn will move the drum 14 and conveyor 21 (FIG. 1).

A reset signal is also supplied to the reset relay 256 via line 258.

The reset relay 256 will reset the counter 232 via line 260. The reset relay may also be actuated by a reset switch 270.

The sort starting switch 271 will cause the sort latching logic or holding circuit 262 to power the sort drive motor 263 via the power relay 213. The motor 263 will drive the conveyor 11 as aforementioned.

When either the collate start switch 251 is thrown, the stop circuit 273 will provide a stop signal to the sort latching circuit 262. Conversely, when the sort start switch 271 is thrown, a stop signal will be provided by the stop circuit 273 to the collating latch circuit 252. This will insure that if the machine is operating in, or is set for the alternate mode, the change of mode will not cause any interference to develop. In the case of the collating mode, the drum 14 will be returned to the home position, before sorting will start.

Depressing the stop switch 272 will cause the machine to cease its operation in either mode.

It is to be understood that other functions of the machine such as offset stacking of collations, stapling, stitching, jam and miss detection have not necessarily been shown or explained. These functions are easily within the skill of the engineer, and are not necessary for an understanding of the invention, i.e., operating machine in either a collating or a sorting mode.

Naturally, many modifications will occur to the skilled practitioner consistant with the inventive purposes. Such changes are deemed to lie within the purview, limits, spirit and scope of the invention.

Having described the invention, what is desired to be protected by Letters Patent is presented by the appended claims.

What is claimed is:

1. A combined sorting and collating machine selectively operable in a plurality of modes of operation in which a plurality of copy sheets are assembled into booklets, said machine comprising:

means defining an infeed location and an outfeed location;

a rotatable drum having a plurality of bins for storing copy sheets, said bins being angularly arranged about the drum;

conveyor means operatively associated with said plurality of bins for conveying copy sheets seriatim from said infeed location to said plurality of bins;

rotatable withdrawing means disposed adjacent said drum for removing copy sheets from the bins of said drum;

a first control means operatively connected to said drum for rotatably actuating said drum to receive copy sheets in a sequential manner in a predetermined number of said bins in order to assemble in each predetermined bin a booklet, thereby defining a machine sorting mode in which the number of booklets corresponds to said predetermined number of bins;

a second control means operatively connected to said drum and said withdrawing means for rotatably actuating said drum and said withdrawing means to extract copy sheets in a sequential manner from a predetermined number of bins in order to successively assemble booklets comprising one sheet from each predetermined bin, thereby defining a machine collating mode in which the number of sheets in each booklet corresponds to said predetermined number of bins; and selector means operatively associated with both said first and second control means, respectively, for selecting which of said first or second control means is operable, whereby said machine is selectively operable in either said sorting mode or said collating mode of operation.

2. The combined sorting and collating machine of claim 1, further comprising corner separator for separating top sheet from the remaining sheets when said sheets are being withdrawn from their respective bins, said separator means being disposed in each bin of said drum, and actuating means for setting each corner separator means to allow the withdrawal of one sheet at a time from each bin.

3. The combined sorting and collating machine of claim 2, wherein said actuating means is operatively connected to said drum for cyclically rotating said drum through at least one complete revolution.

4. The combined sorting and collating machine of claim 2, wherein said corner separator means comprises a pair of spaced apart corner separators, each separator being individually movable from a first position to a second position, biasing means for urging the corner separators to said first position, and camming means disposed adjacent the separator for moving the separators to the second position when actuated, said camming means being actuated by said actuating means which is operatively connected to said camming means.

5. The combined sorting and collating machine of claim 4, wherein said corner separator means further comprises extension members which are each connected to a corner separator and which moves into rotative contact with said camming means as the drum rotates, when said camming means is engageably actuated by said actuating means for contacting said extension members.

6. The combined sorting and collating machine of claim 1 further comprising third control means operatively connected to said drum for rotatably actuating said drum to receive successive pluralities of copy sheets in respective successive bins, thereby defining a machine loading mode, and said selector means further operatively associated with said third control means for selecting which of said first, second or third control means is operable.

* * * * *